US008864132B2

(12) United States Patent
Yamagata

(10) Patent No.: US 8,864,132 B2
(45) Date of Patent: Oct. 21, 2014

(54) PAPER FEEDER AND PRINTER

(71) Applicant: Riso Kagaku Corporation, Tokyo (JP)

(72) Inventor: Akihiro Yamagata, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/172,511

(22) Filed: Feb. 4, 2014

(65) Prior Publication Data

US 2014/0232055 A1 Aug. 21, 2014

(30) Foreign Application Priority Data

Feb. 15, 2013 (JP) ..... 2013-027911

(51) Int. Cl.

| | |
|---|---|
| ***B65H 5/00*** | (2006.01) |
| ***B65H 5/26*** | (2006.01) |
| ***B65H 7/02*** | (2006.01) |
| ***B65H 5/06*** | (2006.01) |

(52) U.S. Cl.

CPC .. *B65H 7/02* (2013.01); *B65H 5/26* (2013.01); *B65H 5/06* (2013.01)

USPC ..... 271/264; 271/256; 271/258.01; 271/270

(58) Field of Classification Search

CPC ..... B65H 2513/10; B65H 2513/108; B65H 2301/5121; B65H 2301/512125

USPC ..... 271/264, 265.01, 256, 258.01, 258.03, 271/270

See application file for complete search history.

(56) References Cited

U.S. PATENT DOCUMENTS

| | | | | |
|---|---|---|---|---|
| 5,119,146 | A * | 6/1992 | Nobumori et al. | 399/396 |
| 8,006,976 | B2 * | 8/2011 | Suzuki et al. | 271/270 |
| 2001/0022422 | A1 * | 9/2001 | Tamura | 271/10.03 |

FOREIGN PATENT DOCUMENTS

| | | | |
|---|---|---|---|
| JP | 2009-40568 | A1 | 2/2009 |

* cited by examiner

*Primary Examiner* — Michael McCullough
*Assistant Examiner* — Howard Sanders
(74) *Attorney, Agent, or Firm* — Nath, Goldberg & Meyer; Jerald L. Meyer; Stanley N. Protigal

(57) ABSTRACT

Upon continuous feeding of a plurality of sheets and upon detection of a leading end of a sheet by a detection unit before an elapse of a first time after a start of a paper feed roller, a controller performs control such that a paper conveyance speed of the paper feed roller is set lower than a paper conveyance speed of a registration roller, and the paper feed roller is stopped after conveying the sheet having the leading end detected for a specified conveyance distance before a next timing of starting the registration roller.

4 Claims, 9 Drawing Sheets

PAPER FEEDER AND PRINTER

CROSS REFERENCE TO RELATED APPLICATION

This application is based upon and claims the benefit of priority from the prior Japanese Patent Application No. 2013-027911, filed on Feb. 15, 2013, the entire contents of which are incorporated herein by reference.

BACKGROUND

1. Technical Field

The present invention relates to a paper feeder and a printer.

2. Related Art

Japanese Patent Application Publication No. 2009-40568 discloses a paper feeder configured to convey a paper sheet on a paper feed tray to registration rollers while picking up the paper sheet by paper feed rollers, and further convey the paper sheet to a print unit by the registration rollers.

The paper feeder corrects the inclination of the paper sheet in such a way that the paper sheet is temporarily stopped and is slacked by hitting against the stopped registration rollers. Thereafter, the registration rollers are driven to send the paper sheet to the print unit. Once the paper sheet exits the registration rollers, the registration rollers are stopped.

SUMMARY OF THE INVENTION

In the paper feed operation as described above, due to so-called duplicate feed, the leading end of a paper sheet to be fed next may be conveyed to the downstream side beyond its originally-proper position on the paper feed tray. When the paper feed operation is performed in such a state, the leading end of the subsequent paper sheet might reach the registration rollers before the registration rollers are stopped after conveying the precedent sheet.

When the leading end of the subsequent paper sheet reaches the registration rollers before the registration rollers are stopped, so-called passing through the registration rollers occurs. The passing through the registration rollers is a phenomenon that the leading end of the paper sheet passes beyond a nip point of the registration rollers when the registration rollers are stopped.

The paper sheet passed through the registration rollers is not corrected for its inclination. When the paper sheet is conveyed by the registration rollers without being corrected for its inclination, an image is printed on the inclined paper sheet by a print unit, resulting in poor print quality. Also, when the paper sheet is conveyed by the registration rollers without being corrected for its inclination, wrinkles or the like may be generated in the paper sheet.

Along with the productivity improvement in printers, an inter-sheet distance in continuous printing tends to be reduced. This makes the paper sheet more likely to pass through the registration rollers. Since it cannot be determined whether or not the paper sheet has passed through the registration rollers, the registration rollers continue to be driven, resulting in a problem such as the poor print quality described above.

It is an object of the present invention to provide a paper feeder and a printer, which are capable of preventing a paper sheet from passing through registration rollers.

A paper feeder in accordance with some embodiments includes: a paper feed roller configured to pick up a sheet loaded on a paper feed tray and convey the sheet in a conveyance direction; a registration roller arranged downstream of the paper feed roller in the conveyance direction and configured to convey the sheet conveyed from the paper feed roller; a detection unit configured to detect the sheet at a position between the paper feed roller and the registration roller; and a controller configured to control the paper feed roller and the registration roller. The controller performs control for each sheet of a plurality of sheets to be fed such that: the paper feed roller is started to convey the sheet for a specified conveyance distance so that the sheet is slacked with a leading end of the sheet hitting against the registration roller; the paper feed roller is stopped after the sheet is conveyed for the specified conveyance distance; after the paper feed roller is stopped, the registration roller is started to convey the sheet; and the registration roller is stopped after the sheet exits the registration roller. Upon continuous feeding of the plurality of sheets, the controller performs control such that the paper feed roller is started to feed a subsequent sheet while the registration roller conveying a precedent sheet is being driven. A timing of starting the registration roller for the plurality of sheets is predetermined. Upon continuous feeding of the plurality of sheets, and upon detection of the leading end of the sheet by the detection unit before an elapse of a first time after a start of the paper feed roller, the controller further performs control such that a paper conveyance speed of the paper feed roller is set lower than a paper conveyance speed of the registration roller, and the paper feed roller is stopped after conveying the sheet having the leading end detected for the specified conveyance distance before a next timing of starting the registration roller.

According to the above configuration, the controller performs control such that the paper conveyance speed of the paper feed rollers is set lower than the paper conveyance speed of the registration rollers when the leading end of the paper sheet is detected by the detection unit before the first time elapses after the start of the paper feed rollers. This increases the inter-sheet distance between the precedent paper sheet conveyed by the registration rollers and the subsequent paper sheet conveyed by the paper feed rollers. Thus, the leading end of the subsequent paper sheet can be prevented from reaching the registration rollers before the registration rollers are stopped. As a result, the paper sheet can be prevented from passing through the registration rollers.

Upon the elapse of the first time after the start of the paper feed roller without the leading end of the sheet being detected by the detection unit, the controller may perform control such that: the paper conveyance speed of the paper feed roller is increased to a first speed V1 after the start of the paper feed roller, and is reduced from the first speed V1 to a second speed V2 at or after a point when the leading end of the sheet is detected by the detection unit; and upon continuous feeding of the plurality of sheets, the paper conveyance speed of the registration roller conveying the precedent sheet is set to a third speed Vg being lower than the first speed V1 and higher than the second speed V2 before the start of the paper feed roller to feed the subsequent sheet. The following inequality may be satisfied, $D>\{(V1-V2)^2/(2|ad1|)-Vg^2/(2|ad2|)\}/(1-V2/Vg)$, where ad1 denotes a deceleration rate in speed of the paper feed roller from the first speed V1 to the second speed V2, ad2 denotes a deceleration rate in speed in stopping the registration roller, and D denotes a distance on a conveyance path between the detection unit and the registration roller.

According to the above configuration, the distance D satisfies the inequality. Accordingly, in normal paper feed, the registration rollers can be configured to be stopped when the leading end of the paper sheet reaches the registration rollers. Thus, the paper sheet can be prevented from passing through the registration rollers.

Upon continuous feeding of the plurality of sheets, the controller may further perform at least one of: suspending the paper feed roller upon the elapse of the first time after the start of the paper feed roller without a trailing end of the precedent sheet being detected by the detection unit; or suspending the paper feed roller upon detection of the leading end of the subsequent sheet within a second time after the detection of the trailing end of the precedent sheet by the detection unit.

According to the above configuration, the paper sheet can be prevented from passing through the registration rollers even in the case where paper sheets overlap due to the duplicate feed or the case where the inter-sheet distance between the paper sheets is very short.

A printer in accordance with some embodiments includes a paper feeder, a print unit, and a paper discharge unit. The paper feeder includes: a paper feed roller configured to pick up a sheet loaded on a paper feed tray and convey the sheet in a conveyance direction; a registration roller arranged downstream of the paper feed roller in the conveyance direction and configured to convey the sheet conveyed from the paper feed roller; a detection unit configured to detect the sheet at a position between the paper feed roller and the registration roller; and a controller configured to control the paper feed roller and the registration roller. The print unit is arranged downstream of the registration roller in the conveyance direction and configured to print the sheet while conveying the sheet being conveyed from the registration roller. The paper discharge unit is configured to discharge the sheet printed by the print unit. The controller performs control for each sheet of a plurality of sheets to be fed such that: the paper feed roller is started to convey the sheet for a specified conveyance distance so that the sheet is slacked with a leading end of the sheet hitting against the registration roller; the paper feed roller is stopped after the sheet is conveyed for the specified conveyance distance; after the paper feed roller is stopped, the registration roller is started to convey the sheet; and the registration roller is stopped after the sheet exits the registration roller. Upon continuous feeding of the plurality of sheets, the controller performs control such that the paper feed roller is started to feed a subsequent sheet while the registration roller conveying a precedent sheet is being driven. A timing of starting the registration roller for the plurality of sheets is predetermined. Upon continuous feeding of the plurality of sheets, and upon detection of the leading end of the sheet by the detection unit before an elapse of a first time after a start of the paper feed roller, the controller further performs control such that a paper conveyance speed of the paper feed roller is set lower than a paper conveyance speed of the registration roller, and the paper feed roller is stopped after conveying the sheet having the leading end detected for the specified conveyance distance before a next timing of starting the registration roller. Upon continuous feeding of the plurality of sheets, the controller further performs at least one of: suspending the paper feed roller upon the elapse of the first time after the start of the paper feed roller without a trailing end of the precedent sheet being detected by the detection unit; or suspending the paper feed roller upon detection of the leading end of the subsequent sheet within a second time after a detection of the trailing end of the precedent sheet by the detection unit. Upon suspension of the paper feed roller, the controller further performs control such that: the precedent sheet is printed by the print unit and then a printed precedent sheet is discharged by the paper discharge unit; and after the printed precedent sheet is discharged, the subsequent sheet under suspension of conveyance is conveyed by the paper feed roller and the registration roller, further is conveyed through the print unit without printing, and then is discharged by the paper discharge unit.

According to the above configuration, when the paper feed rollers are suspended, the controller allows the print unit to perform printing on the precedent paper sheet, and the paper discharge unit to discharge the precedent paper sheet. Thereafter, the controller controls the paper feed rollers and the registration rollers to convey the subsequent paper sheet, of which conveyance is suspended. Then, the controller allows the print unit to convey the paper sheet without printing, and the paper discharge unit to discharge the sheet. Thus, even when the paper feed rollers are suspended, the user no longer needs to remove the paper sheet from the printer. Also, the paper sheet, of which conveyance is suspended, can be reused.

DETAILED DESCRIPTION

Figure 1:
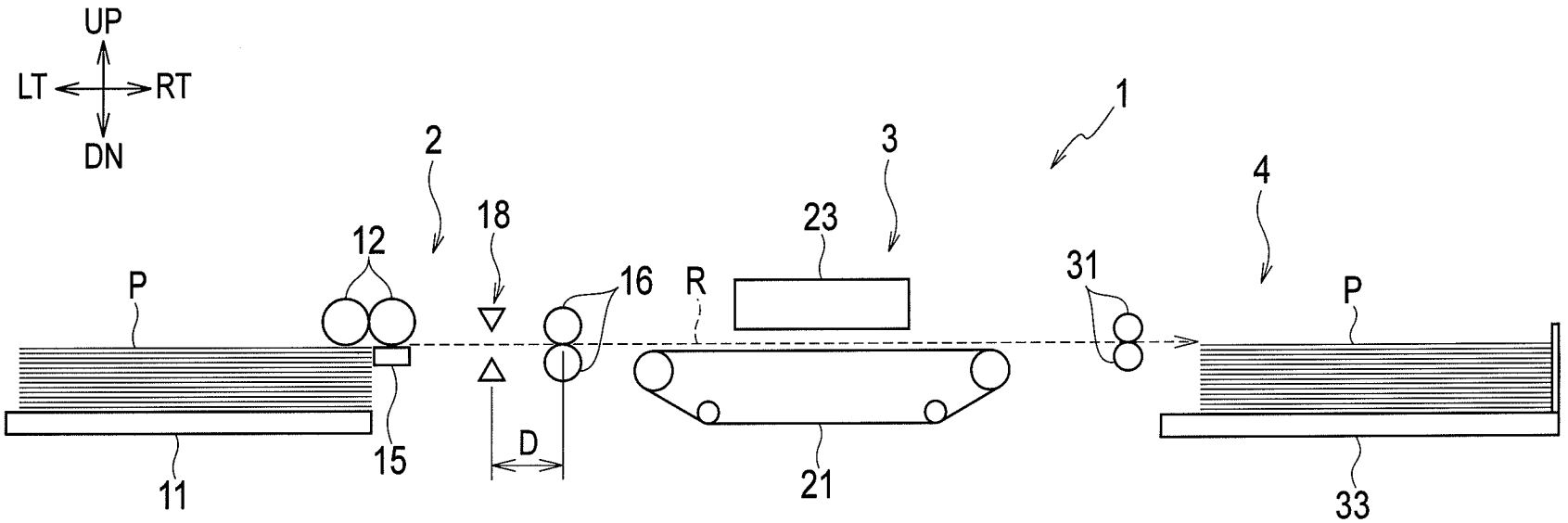
FIG. 1 is a schematic configuration diagram of a printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With reference to the drawings, embodiments of the present invention will be described below. Throughout the drawings, the same or similar parts or constituent elements will be denoted by the same or similar reference numerals. However, it should be noted that the drawings are conceptual and different from actual ones. Moreover, as a matter of course, also among the drawings, there are included portions in which dimensional relationships and ratios are different from each other. Note that, in FIGS. 1, 5, 7A, 7B and 11A to 11C, RT, LT, UP and DN represent the right side, left side, upside and downside, respectively.

Figure 2:
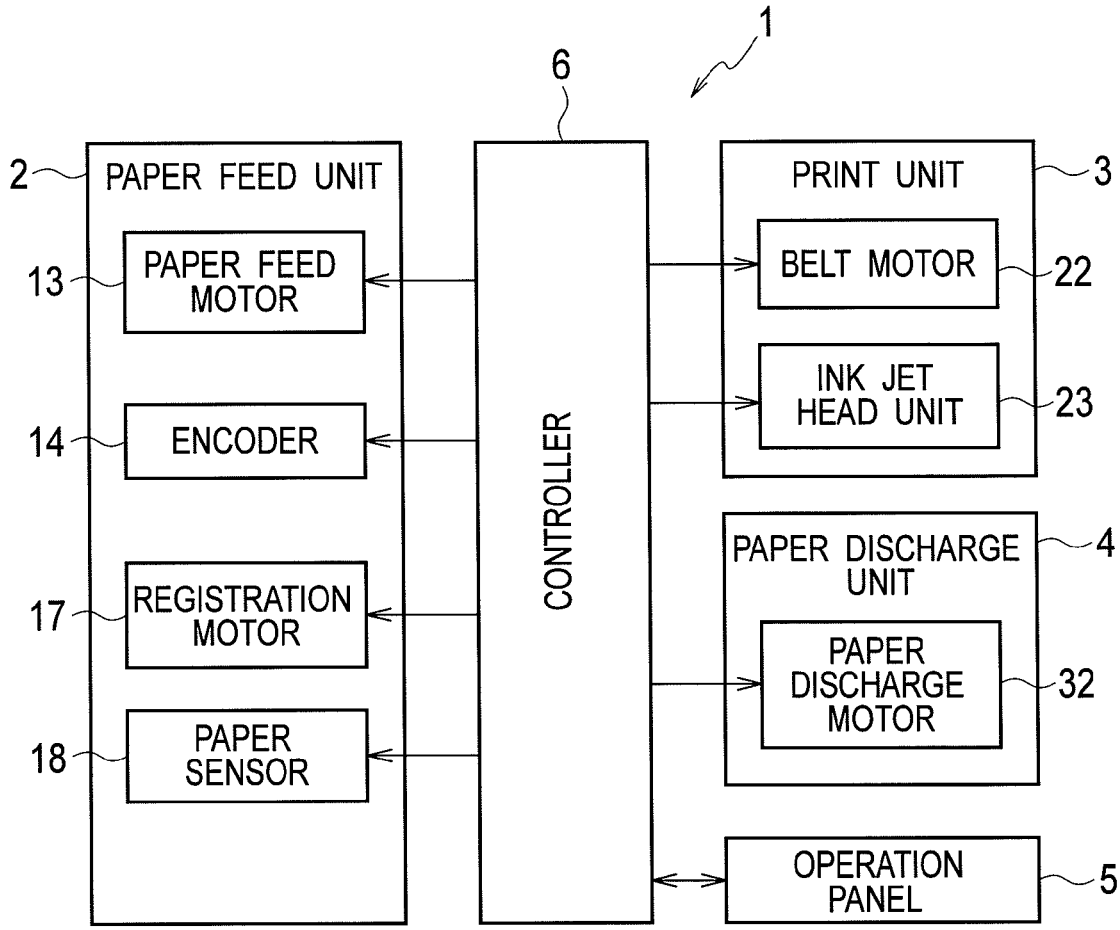
FIG. 2 is a block diagram showing a configuration of a control system of the printer according to the embodiment.

FIG. 1 is a schematic configuration diagram of a printer according to an embodiment of the present invention. FIG. 2 is a block diagram showing a configuration of a control system of the printer shown in FIG. 1. In the following description, it is assumed that a paper front direction in FIG. 1 where a user is positioned is the front. As shown in FIG. 1, when seen from the user, up, down, left and right sides are up, down, left and right directions, respectively. Also, a path indicated by the broken line in FIG. 1 is a conveyance path R through which a paper sheet is conveyed, and a direction from the left to the right is a conveyance direction. Upstream and downstream in the following description mean upstream and downstream in the conveyance direction of the paper sheet.

As shown in FIGS. 1 and 2, a printer 1 includes a paper feed unit 2, a print unit 3, a paper discharge unit 4, an operation panel 5 and a controller 6. A paper feeder includes the paper feed unit 2 and the controller 6.

The paper feed unit 2 feeds a paper sheet P to the print unit 3. The paper feed unit 2 is arranged on the uppermost stream side of the conveyance path R. The paper feed unit 2 includes a paper feed tray 11, paper feed rollers 12, a paper feed motor 13, an encoder 14, a stripper pad 15, registration rollers 16, a registration motor 17 and a paper sensor (detector) 18.

The paper sheet P that is a print medium is loaded on the paper feed tray 11.

The paper feed rollers 12 picks up the paper sheet P loaded on the paper feed tray 11 one by one and conveys the paper sheet toward the registration roller 16. The paper feed rollers 12 are arranged above the paper feed tray 11. The paper feed rollers 12 are rotated by drive force of the paper feed motor 13, and are configured to be rotated along with the movement of the paper sheet P when the registration rollers 16 convey the paper sheet P.

The paper feed motor 13 drives the paper feed rollers 12 to be rotated.

The encoder 14 detects a rotation angle of a rotary shaft of the paper feed motor 13, and generates a pulse signal corresponding to the rotation angle.

The stripper pad 15 separates paper sheets P so that the paper sheets P can be conveyed one by one by the paper feed rollers 12. The stripper pad 15 comes into pressure contact from below with the paper feed roller 12 on the downstream side.

After the paper sheet P conveyed from the paper feed rollers 12 is slacked by hitting against the registration rollers 16, the registration rollers 16 convey the paper sheet P toward the print unit 3 at a predetermined timing. The registration rollers 16 are arranged downstream of the paper feed rollers 12.

The registration motor 17 drives the registration rollers 16 to be rotated.

The paper sensor 18 is arranged at a predetermined position between the paper feed rollers 12 and the registration rollers 16, and detects the paper sheet P conveyed through the conveyance path R. As the paper sensor 18, an optical sensor having a light emitting element and a light receiving element is used, for example.

The print unit 3 prints an image on the paper sheet P while conveying the paper sheet P. The print unit 3 is arranged downstream of the paper feed unit 2. The print unit 3 includes a belt conveyance unit 21, a belt motor 22 and an ink jet head unit 23.

The belt conveyance unit 21 holds the paper sheet P fed by the paper feed unit 2 on a loop-shaped conveyer belt, and conveys the paper sheet P by driving and turning the conveyer belt. The belt conveyance unit 21 is arranged downstream of the registration rollers 16.

The belt motor 22 drives and turns the conveyer belt holding and conveying the paper sheet P in the belt conveyance unit 21.

The ink jet head unit 23 has multiple line-type ink jet heads, each having multiple nozzles arranged in a direction (front-back direction) approximately orthogonal to the conveyance direction of the paper sheet P. The ink jet head unit 23 is arranged above the belt conveyance unit 21. The ink jet head unit 23 ejects ink from the ink jet heads onto the paper sheet P conveyed by the belt conveyance unit 21 to print an image.

The paper discharge unit 4 discharges the paper sheet P printed by the print unit 3. The paper discharge unit 4 is arranged downstream of the print unit 3. The paper discharge unit 4 includes paper discharge rollers 31, a paper discharge motor 32 and a paper receiving tray 33.

The paper discharge rollers 31 convey the paper sheet P conveyed by the belt conveyance unit 21 and then discharge the paper sheet P onto the paper receiving tray 33. The paper discharge rollers 31 are arranged between the belt conveyance unit 21 and the paper receiving tray 33 along the conveyance path R.

The paper discharge motor 32 drives the paper discharge rollers 31 to be rotated.

The discharged paper sheet P is loaded on the paper receiving tray 33. The paper receiving tray 33 is arranged at the downstream end of the conveyance path R The operation panel 5 receives an input operation by the user, and displays various information and the like. The operation panel 5 includes: an input unit (not shown) having operation buttons, a touch panel and the like for the user to perform various input operations; and a display unit (not shown) including a liquid crystal display panel and the like to display various information and the like.

The controller 6 controls operations performed by the respective units in the printer 1. The controller 6 includes a CPU, a RAM, a ROM and the like.

To be more specific, in paper feed control on the paper feed unit 2, the controller 6 starts the paper feed rollers 12 for each paper sheet to be fed, and stops the paper feed rollers 12 after the leading end of the paper sheet P hits against the registration rollers 16. Thereafter, the controller 6 starts the registration rollers 16 and then stops the registration rollers 16 when the paper sheet P exits the registration rollers 16. In the case of continuously feeding multiple sheets of the paper sheet P, the controller 6 starts the paper feed rollers 23 to feed the next sheet of the paper sheet P while the registration rollers conveying the precedent sheet of the paper sheet P is in operation. Also, the controller 6 performs control such that ink is ejected by the ink jet head unit 23 to perform printing on the paper sheet P fed by the paper feed unit 2 while conveying the paper sheet P by the belt conveyance unit 21 and then the paper sheet P is discharged by the paper discharge unit 4.

Next, operations of the printer 1 will be described.

A print operation is started, for example, when the printer 1 receives print data from a personal computer. When the print operation is started, the controller 6 starts the belt motor 22 to drive and turn the conveyer belt of the belt conveyance unit 21. The controller 6 drives the belt conveyance unit 21 so that the paper sheet P can be conveyed at a predetermined print conveyance speed (a third speed) Vg. Also, the controller 6 starts the paper discharge motor 32 to drive the paper discharge rollers 31.

Figure 3:
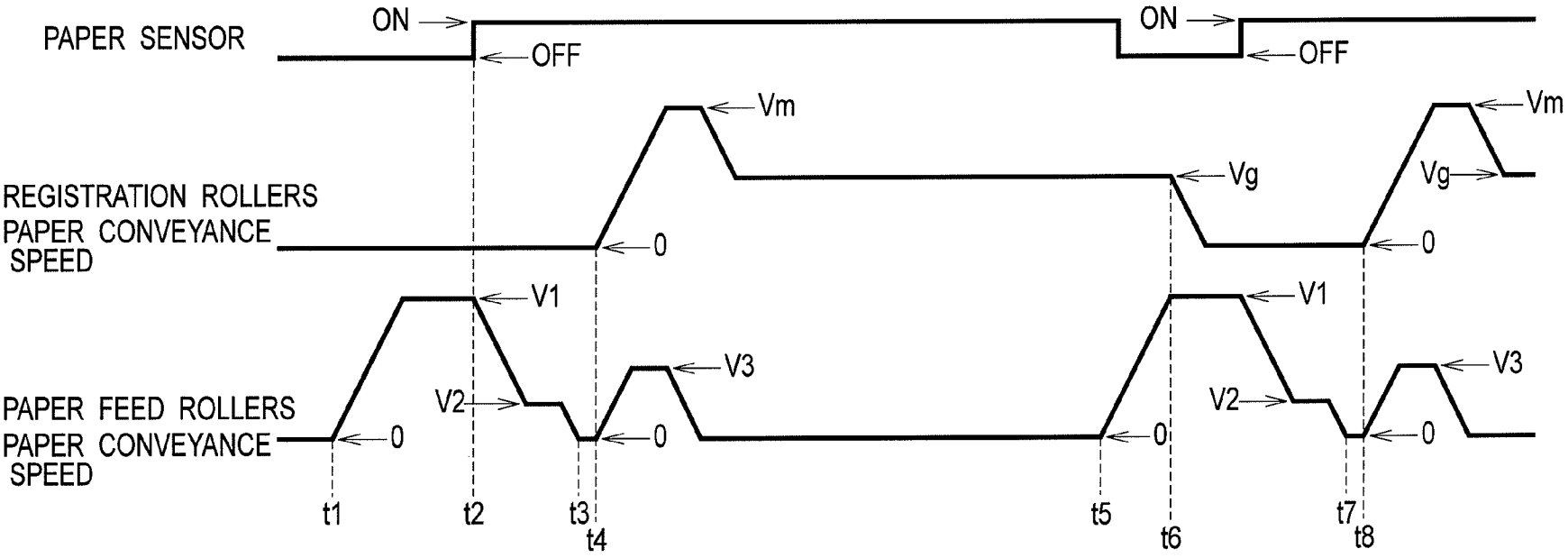
FIG. 3 is a timing chart of paper feed control.

Then, the controller 6 controls the paper feed unit 2 to feed the paper sheets. FIG. 3 is a timing chart of paper feed control. The upper part of FIG. 3 shows ON and OFF states of the paper sensor 18. Here, the ON state is a state where the paper sensor 18 detects a paper sheet (where there is the paper P at a target position by the paper sensor 18) and the OFF state is a state where the paper sensor 18 detects no paper sheet (where there is no paper sheet P at the target position by the paper sensor 18). The middle part of FIG. 3 shows the transition of a paper conveyance speed of the registration rollers 16. The lower part of FIG. 3 shows the transition of a paper conveyance speed of the paper feed rollers 12.

At a time t1 in FIG. 3 that is the time to start driving the paper feed rollers 12, the controller 6 starts the paper feed rollers 12 by the paper feed motor 13. Thus, the paper sheet P on the paper feed tray 11 is picked up by the paper feed rollers 12 and starts to be conveyed toward the registration rollers 16.

After starting the paper feed rollers 12, the controller 6 increases the paper conveyance speed of the paper feed rollers 12 at a predetermined acceleration rate au1. When the paper conveyance speed of the paper feed rollers 12 reaches a predetermined speed (a first speed) V1, the controller 6 maintains the speed V1.

When the leading end of the paper sheet P conveyed at the speed V1 is detected by the paper sensor 18 (the paper sensor 18 is turned on), the controller 6 starts to reduce the paper conveyance speed of the paper feed rollers 12 from V1 at a predetermined acceleration rate ad1 at that point (a time t2) or subsequent thereto. Once the paper conveyance speed of the paper feed rollers 12 is reduced to a predetermined speed (a second speed) V2, the controller 6 maintains the speed V2. The leading end of the paper sheet P hits against the registration rollers 16 at the speed V2. Then, the controller 6 determines when to start reducing the paper conveyance speed of the paper feed rollers 12 from V1, on the basis of the timing when the leading end of the paper sheet P is detected by the paper sensor 18.

Thereafter, the controller 6 stops the paper feed rollers 12. In this event, the paper feed rollers 12 are decelerated from the speed V2 at the acceleration rate ad1, and then stopped. Between the time t1 when the paper feed rollers 12 are started and the time t3 when the paper feed rollers are stopped, the paper sheet P is conveyed for a specified conveyance distance. Accordingly, the leading end of the paper sheet P hits against the registration rollers 16, and thus the paper sheet P is slacked by a predetermined amount. As a result, the inclination of the paper sheet P is corrected.

The specified conveyance distance is a distance obtained by adding an amount of slack formed by the paper sheet P to a distance between the paper feed rollers 12 and the registration rollers 16. The amount of slack is a reduced length of the paper sheet P from its original length when the paper sheet P is slacked by hitting against the registration rollers 16.

After stopping the paper feed rollers 12, the controller 6 starts the registration rollers 16 by the registration motor 17 at a time t4. After starting the registration rollers 16, the controller 6 increases the paper conveyance speed thereof at a predetermined acceleration rate au2. When the paper conveyance speed of the registration rollers 16 reaches a predetermined speed Vm, the controller 6 maintains the speed Vm for a predetermined period of time. Thereafter, the controller 6 starts to reduce the paper conveyance speed of the registration rollers 16 down to a print conveyance speed Vg at a predetermined acceleration rate ad2. The controller 6 reduces the paper conveyance speed of the registration rollers 16 down to the print conveyance speed Vg until the leading end of the paper sheet P reaches the belt conveyance unit 21.

Moreover, at the time t4, the controller 6 starts the paper feed rollers 12 by the paper feed motor 13 for an assist operation. After starting the paper feed rollers 12, the controller 6 increases the paper conveyance speed thereof up to a predetermined speed V3. Then, the controller 6 stops the paper feed rollers 12 after maintaining the speed V3 for a predetermined period of time. This assist operation is to assist the paper conveyance by the registration rollers 16. The assist operation is terminated before the trailing end of the paper sheet P exits the paper feed rollers 12.

While the registration rollers 16 are driven at the print conveyance speed Vg, the controller 6 starts the paper feed rollers 12 at a time t5 to feed the next paper sheet P.

Thereafter, at a time t6 when the trailing end of the paper sheet P exits the registration rollers 16, the controller 6 controls the registration rollers 16 to be stopped. Accordingly, the registration rollers 16 are decelerated from the print conveyance speed Vg at an acceleration rate ad2, and then stopped.

The paper feed rollers 12 started at the time t5 are driven in the same manner as the drive at the times t1 to t4 described above. As described above, although the leading end of the paper sheet P hits against the registration rollers 16 when the paper conveyance speed of the paper feed rollers 12 is V2, the registration rollers 16 are stopped in this event. Thus, until a time t7 when the paper feed rollers 12 are stopped, the paper sheet P hitting against the registration rollers 16 is slacked by a predetermined amount. As a result, the inclination of the paper sheet P is corrected.

After the paper feed rollers 12 are stopped, the controller 6 starts the registration rollers 16 and the paper feed rollers 12 at a time t8, and drives the both rollers in the same manner as the time t4 and subsequent thereto described above.

The timing of starting the registration rollers 16 (the times t4 and t8) and the subsequent speed control schedule are predetermined according to the paper size. In the case of continuously feeding multiple paper sheets, the timing of starting the registration rollers 16 is a predetermined interval corresponding to the paper size. Also, the timing of starting the paper feed rollers 12 (the times t1 and t5) is predetermined to be the timing that precedes the timing of starting the registration rollers 16 (the times t4 and t8) by a predetermined period of time.

By the paper feed control as described above, the controller 6 realizes continuous paper feed for the number of paper sheets to be fed (the number of sheets to be printed). When the fed paper sheet P is conveyed from the registration rollers 16 to the belt conveyance unit 21, the controller 6 allows the ink jet head unit 23 to eject ink onto the paper sheet P conveyed by the belt conveyance unit 21. Thus, an image is printed on the paper sheet P. The printed paper sheet P is discharged onto the paper receiving tray 33 by the paper discharge rollers 31 in the paper discharge unit 4.

Next, description will be given of a positional relationship between the paper sensor 18 and the registration rollers 16 in the paper feed unit 2 subjected to the paper feed control as described above.

As shown in FIG. 1, a distance on the conveyance path R between the target position of the paper sensor 18 and a nip point of the registration rollers 16 is assumed to be D.

Figure 4:
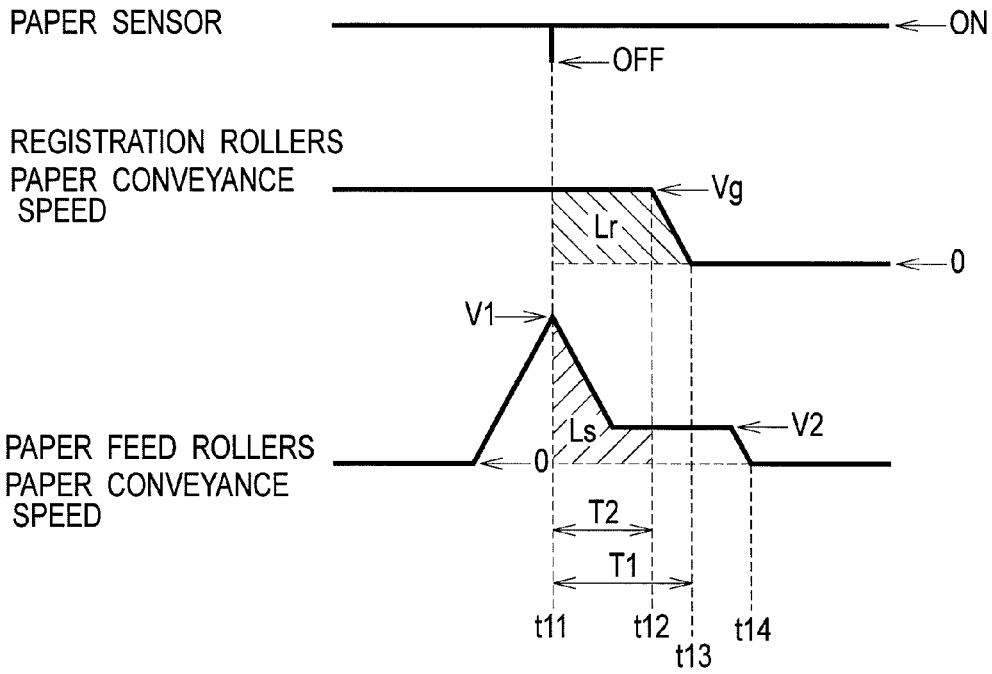
FIG. 4 is a timing chart used to explain a positional relationship between a paper sensor and registration rollers.

Here, a situation represented by a timing chart of FIG. 4 is considered. FIG. 4 shows a worst-case situation as a situation that allows the continuation of the paper feed control described above. In this situation, a distance (inter-sheet distance) between the trailing end of the precedent paper sheet P and the leading end of the subsequent paper sheet P is reduced. Also, there is no more inter-sheet distance between the precedent paper sheet P and the subsequent paper sheet P when the trailing end of the precedent paper sheet P passes the paper sensor 18. At that point, the speed of the subsequent paper sheet P reaches V1 that is the maximum speed of the paper feed rollers 12. This situation is considered to occur in a case where the precedent paper sheet P is slipped and delayed in conveyance, for example, or in other similar cases.

As described above, in FIG. 4, the point when the trailing end of the precedent paper sheet P is detected by the paper sensor 18, the point when the leading end of the subsequent paper sheet P is detected by the paper sensor 18, and the point when the paper conveyance speed of the paper feed rollers 12 reaches V1 coincide with each other. From this point, i.e., a time t11, speed reduction of the paper feed rollers 12 from the speed V1 to the speed V2 is started. At a time t12 when the paper feed rollers 12 are being driven at the speed V2, control to stop the registration rollers 16 driven at the print conveyance speed Vg is started. The time t12 is the timing when the trailing end of the paper sheet P exits the registration rollers 16 (i.e., passes the nip point of the registration rollers 16). The registration rollers 16 are stopped at a time t13, and then the paper feed rollers 12 are stopped at a time t14.

As shown in FIG. 4, a time period between the times t11 and t13 is T1, and a time period between the times t11 and t12 is T2. Also, a conveyance distance of the paper sheet P by the registration rollers 16 in the time period T1 is Lr, and a conveyance distance of the paper sheet P by the paper feed rollers 12 in the time period T2 is Ls.

As described above, FIG. 4 shows the situation where the trailing end of the precedent paper sheet P passes the paper sensor 18 and, at the same time, the leading end of the subsequent paper sheet P reaches the paper sensor 18, more specifically, the situation where the leading end of the subsequent paper sheet P reaches the paper sensor 18 as soon as the trailing end of the precedent paper sheet P passes the paper sensor 18. Even in this situation, if Lr>Ls, the registration rollers 16 are stopped when the leading end of the paper sheet P reaches the registration rollers 16. Therefore, setting the distance D so as to satisfy Lr>Ls enables the configuration in which the registration rollers 16 are stopped when the leading end of the paper sheet P reaches the registration rollers 16 in the paper feed control of this embodiment described above.

The conveyance distance Lr corresponds to an area of a region indicated by the rising diagonal stroke from bottom right to top left shown in FIG. 4, and is expressed in the following equation (1). Also, the conveyance distance Ls corresponds to an area of a region indicated by the rising diagonal stroke from bottom left to top right shown in FIG. 4, and is expressed in the following equation (2).

$$Lr=T2\times Vg+Vg^2/(2|ad2|) \quad (1)$$

$$Ls=(V1+V2)\times(V1-V2)/(2|ad1|)+V2\times\{T2-(V1-V2)/|ad1|\} \quad (2)$$

Here, the acceleration rate ad1 during speed reduction of the paper feed rollers 12 and the acceleration rate ad2 during speed reduction of the registration rollers 16 are fixed values.

Moreover, the time period T2 is expressed in the following equation (3).

$$T2=D/Vg \quad (3)$$

The following inequality (4) is derived from the equations (1) to (3) and Lr>Ls.

$$D>\{(V1-V2)^2/(2|ad1|)-Vg^2/(2|ad2|)\}/(1-V2/Vg) \quad (4)$$

Therefore, in the printer 1, the distance D is set so as to satisfy the inequality (4).

For example, when V1=1850 mm/s, V2=400 mm/s, Vg=632 mm/s, ad1=−80000 mm/s$^2$, and ad2=−40000 mm/s$^2$, D>22.2 mm is established by the inequality (4).

Meanwhile, in the printer 1, so-called duplicate feed may occur when the paper feed rollers 12 send out the paper sheet P. The duplicate feed is a phenomenon that, when the paper sheet P at the top on the paper feed tray 11 is picked up by the paper feed rollers 12, the paper sheet P therebelow is dragged by the paper sheet P at the top to move toward the downstream side.

Figure 5:
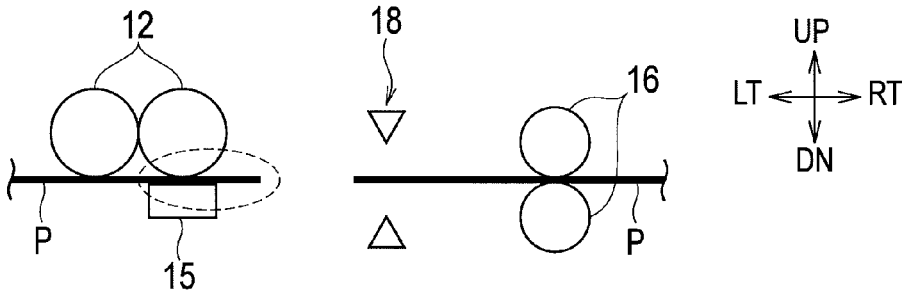
FIG. 5 is an explanatory diagram of a paper sheet jutting due to duplicate feed.
Figure 6:
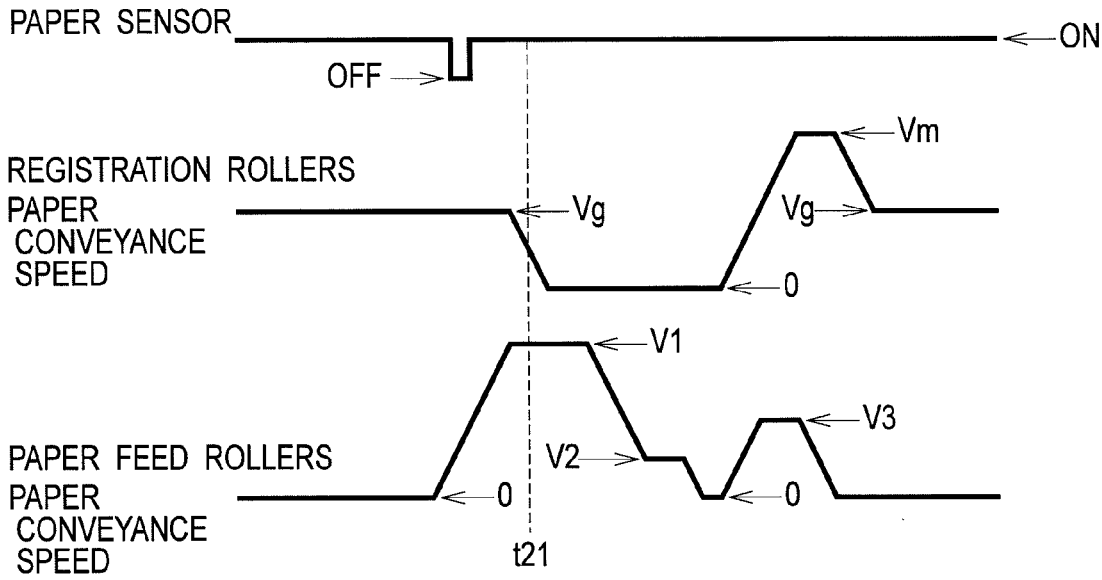
FIG. 6 is an example of a timing chart during abnormal paper feed.

When the duplicate feed occurs, the leading end of the paper sheet P to be fed next may be conveyed beyond its originally-proper position to the downstream side, as indicated by the broken circle in FIG. 5. When a paper feed operation is performed for the subsequent paper sheet P in such a state, a distance (inter-sheet distance) between the trailing end of the precedent paper sheet P and the leading end of the subsequent paper sheet P is reduced to be shorter than the case of normal paper feed without duplicate feed. As a result, the leading end of the paper sheet P might reach the registration rollers 16 at the timing when the registration rollers 16 are not yet stopped such as a time t21 in FIG. 6, for example.

Figure 7A:
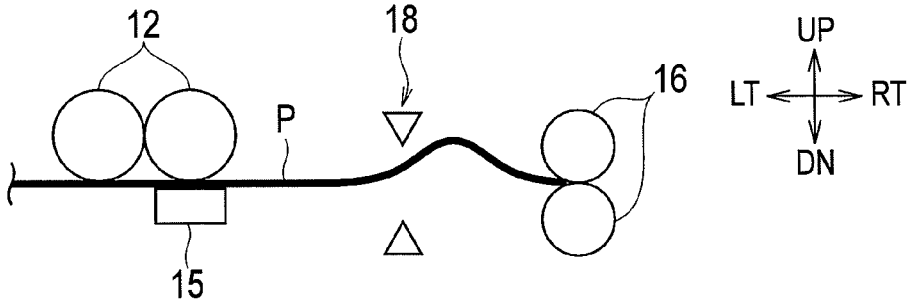
FIG. 7A is a diagram showing a state where a paper sheet hits against the registration rollers during normal paper feed.
Figure 7B:
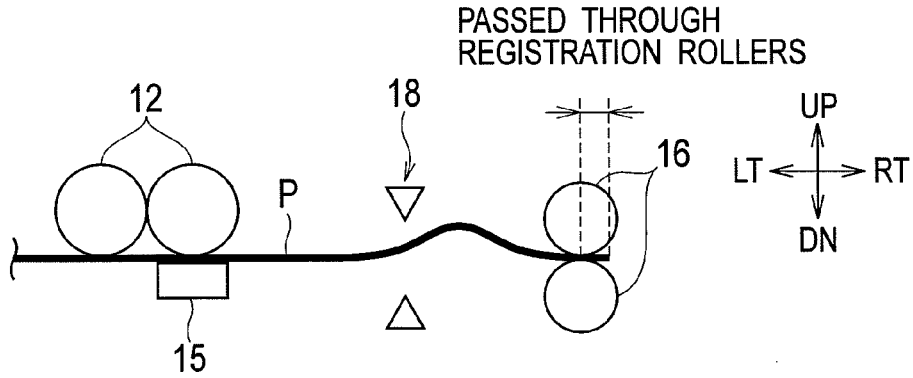
FIG. 7B is a diagram showing a state of passing through the registration rollers during abnormal paper feed.

In the normal paper feed, as described above, the registration rollers 16 are stopped when the leading end of the paper sheet P sent out by the paper feed rollers 12 hits against the registration rollers. In this case, at the point when the paper feed rollers 12 finished sending out the paper sheet P are stopped, the paper sheet P is slacked by a predetermined amount with the leading end thereof hitting against the registration rollers 16 as shown in FIG. 7A. On the other hand, if the leading end of the paper sheet P reaches the registration rollers 16 at the timing when the registration rollers 16 are not yet stopped, the leading end of the paper sheet P passes through the registration rollers 16 beyond the nip point of the registration rollers as shown in FIG. 7B.

The paper sheet P that has passed through the registration rollers is not corrected for its inclination. When the paper sheet P is conveyed by the registration rollers 16 without being corrected for its inclination, an image is printed on the inclined paper sheet P by the print unit 3, resulting in poor print quality. Also, when the paper sheet P is conveyed by the registration rollers 16 without being corrected for its inclination, wrinkles or the like may be generated in the paper sheet P.

To counter this situation, the printer 1 prevents the paper sheet from passing through the registration rollers by performing the following first to third duplicate feed countermeasure processing.

First, the first duplicate feed countermeasure processing will be described.

In the first duplicate feed countermeasure processing, even when duplicate feed occurs, the leading end of the subsequent paper sheet P is prevented from reaching the registration rollers 16 until the registration rollers 16 finished conveying the precedent paper sheet P are stopped, if there is a certain inter-sheet distance between the precedent paper sheet P and the subsequent paper sheet P.

When a paper feed operation is performed for the subsequent paper sheet P with its leading end conveyed beyond its originally-proper position to the downstream side by the duplicate feed, the leading end of the subsequent paper sheet P reaches the paper sensor 18 at a timing earlier than the case of the normal paper feed. For this reason, the leading end of the subsequent paper sheet P may be detected by the paper sensor 18 before the paper conveyance speed of the paper feed rollers 12 started to feed the subsequent paper sheet P reaches V1.

To prevent such a situation, the controller 6 changes the target speed from V1 to V2 when the leading end of the paper sheet P is detected by the paper sensor 18 before the paper conveyance speed reaches V1 after the start of the paper feed rollers 12, in other words, before a specified time Tka (a first time) elapses after the start of the paper feed rollers 12. Here, the specified time Tka is the time between when the paper feed rollers 12 are started and when the paper conveyance speed thereof is increased at a constant acceleration rate au1 to reach the speed V1.

Figure 8:
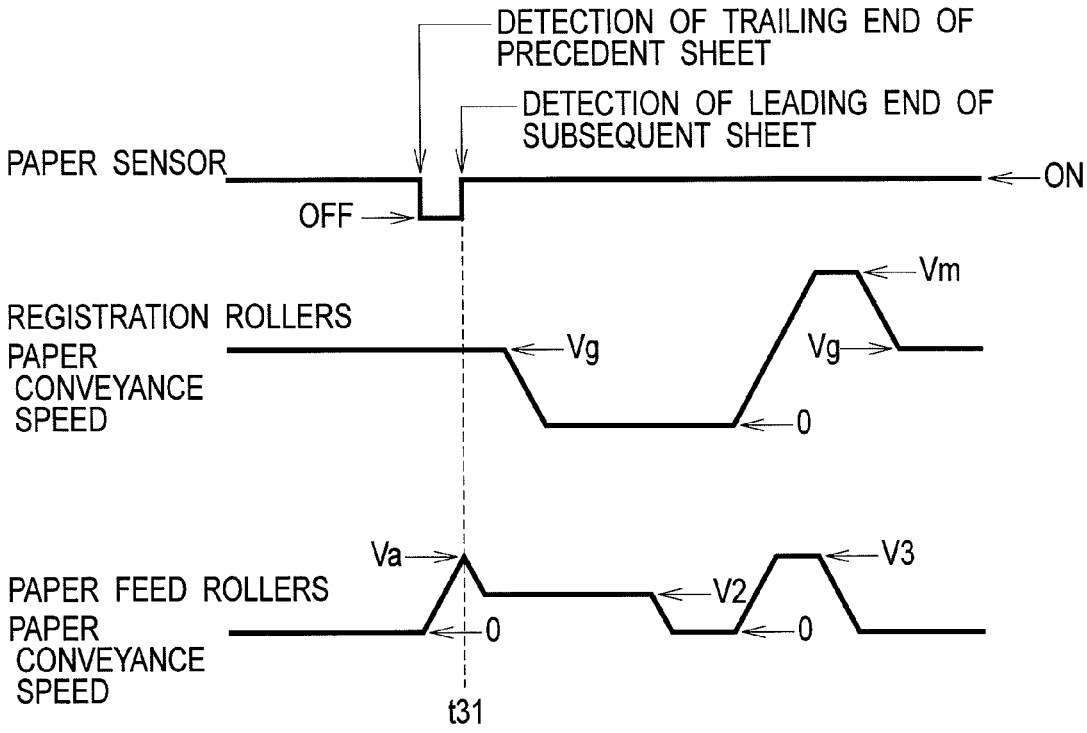
FIG. 8 is a timing chart used to explain first duplicate feed countermeasure processing.

As shown in FIG. 8, for example, it is assumed that the paper conveyance speed of the paper feed rollers 12 is Va, which is lower than V1, at a time t31 when the leading end of the subsequent paper sheet P, of which feed is started subsequent to the precedent paper sheet P, is detected by the paper sensor 18. In this case, the leading end of the paper sheet P is detected by the paper sensor 18 before the paper conveyance speed reaches V1 after the paper feed rollers 12 are started. Here, the speed Va is assumed to be higher than the speed V2. Therefore, the controller 6 starts reducing the paper conveyance speed of the paper feed rollers 12 from the time t31 to set the target speed V2.

Thereafter, the controller 6 controls the speed V2 to be maintained and the paper feed rollers 12 to be stopped when the conveyance distance after the start of the paper feed rollers 12 reaches a specified conveyance distance. This increases the inter-sheet distance between the precedent paper sheet P conveyed by the registration rollers 16 at the print conveyance speed Vg and the subsequent paper sheet P conveyed by the paper feed rollers 12 at the speed V2 lower than the print conveyance speed Vg. As a result, the leading end of the subsequent paper sheet P can be prevented from reaching the registration rollers 16 before the registration rollers 16 are stopped. Thus, the paper sheet can be prevented from passing through the registration rollers.

Next, the second duplicate feed countermeasure processing will be described.

In the second duplicate feed countermeasure processing, the paper feed rollers 12 are suspended in a situation where the precedent paper sheet P and the subsequent paper sheet P are conveyed in an overlapped state by the duplicate feed, i.e., a situation where the trailing end of the precedent paper sheet P and the leading end of the subsequent paper sheet P are overlapped with each other and conveyed.

Figure 9:
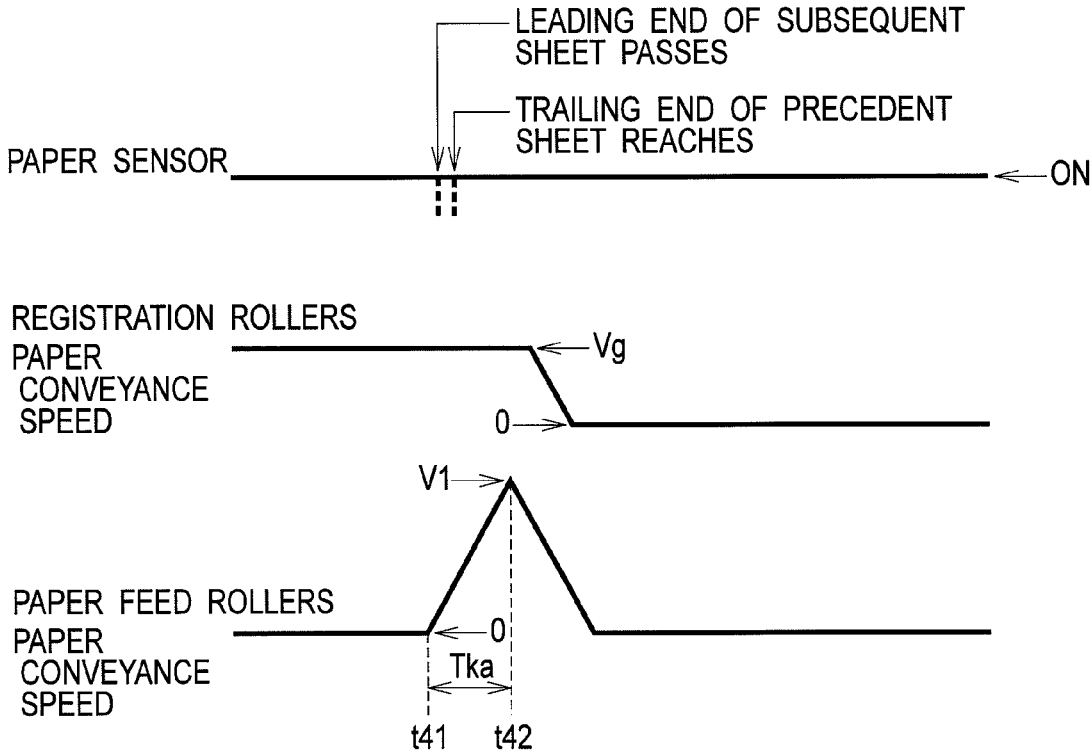
FIG. 9 is a timing chart used to explain second duplicate feed countermeasure processing.

When such overlap occurs, as shown in FIG. 9, the leading end of the subsequent paper sheet P reaches the paper sensor 18 before the trailing end of the precedent paper sheet P passes the paper sensor 18. Accordingly, the paper sensor 18 is not turned off. In this case, the slack of the subsequent paper sheet P cannot be controlled since the leading end of the subsequent paper sheet P cannot be detected. Thus, not only is inclination correction not performed but there is a possibility that a jam occurs.

To prevent such a situation, the controller 6 suspends the paper feed rollers 12 as a paper jam error when the paper sensor 18 is not turned off between a time t41 when the paper feed rollers 12 are started to feed the subsequent paper sheet P and a time t42 when an increase in the paper conveyance speed to V1 is completed, as shown in FIG. 9. In other words, the controller 6 suspends the paper feed rollers 12 when the paper sensor 18 is not turned off within a specified time Tka after the paper feed rollers 12 are started to feed the subsequent paper sheet P. Thus, the paper sheet can be prevented from passing through the registration rollers.

Next, the third duplicate feed countermeasure processing will be described.

Even if no overlap occurs, when a time between when the trailing end of the precedent paper sheet P passes the paper sensor 18 and when the leading end of the subsequent paper sheet P reaches the paper sensor 18 is too short, there is a possibility that the paper sheet cannot be prevented from passing through the registration rollers. In the third duplicate feed countermeasure processing, the paper feed rollers 12 are suspended in such a situation.

To be more specific, in the third duplicate feed countermeasure processing, the paper feed rollers 12 are suspended when the leading end of the subsequent paper sheet P is detected within a specified time Tkb (a second time) after the trailing end of the precedent paper sheet P is detected by the paper sensor 18.

The specified time Tkb will be described. The specified time Tkb is a value to determine whether or not the subsequent paper sheet P catches up with the precedent paper sheet P, on the basis of a time Terr between the detection of the trailing end of the precedent paper sheet P and the detection of the leading end of the subsequent paper sheet P by the paper sensor 18.

Figure 10:
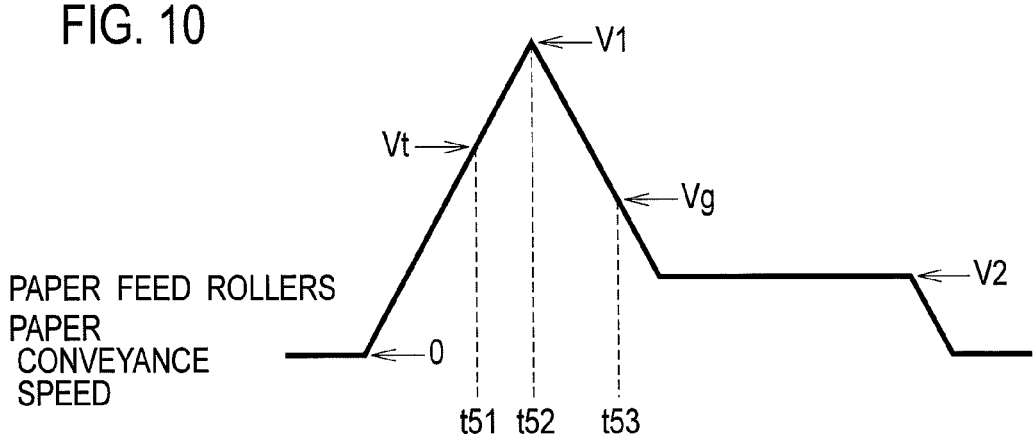
FIG. 10 is a timing chart used to explain third duplicate feed countermeasure processing.

In the first duplicate feed countermeasure processing described above, when the leading end of the paper sheet P is detected by the paper sensor 18 before the paper conveyance speed reaches V1 after the start of the paper feed rollers 12, the target speed of the paper conveyance speed of the paper feed rollers 12 is changed from V1 to V2 from that point. Thus, as a pattern that maximizes a catch-up distance of the subsequent paper sheet P, a pattern as shown in FIG. 10 is assumed, in which speed reduction is started when the paper conveyance speed of the paper feed rollers 12 reaches V1. The catch-up distance is a reduction in a distance between the trailing end of the precedent paper sheet P and the leading end of the subsequent paper sheet P within the time between when the leading end of the subsequent paper sheet P reaches the paper sensor 18 and when the precedent paper sheet P passes through the registration rollers 16 and the registration rollers 16 are stopped.

Figure 11A:
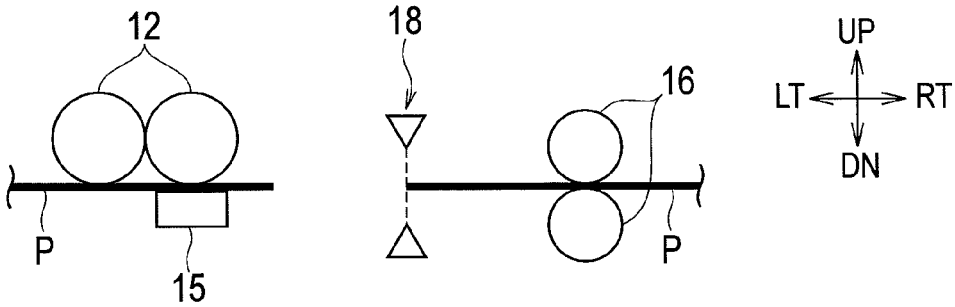
FIGS. 11A to 11C are diagrams showing paper transport states used to explain the third duplicate feed countermeasure processing, FIG. 11A showing a paper transport state when a trailing end of a precedent sheet passes the paper sensor, FIG. 11B showing a paper transport state when the trailing end of the precedent sheet reaches the paper sensor, and FIG. 11C showing a paper transport state when the trailing end of the precedent sheet exits the registration rollers.
Figure 11B:
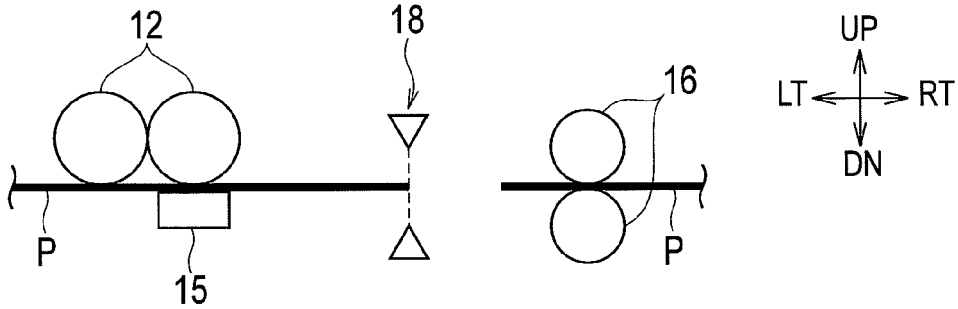
Figure 11C:
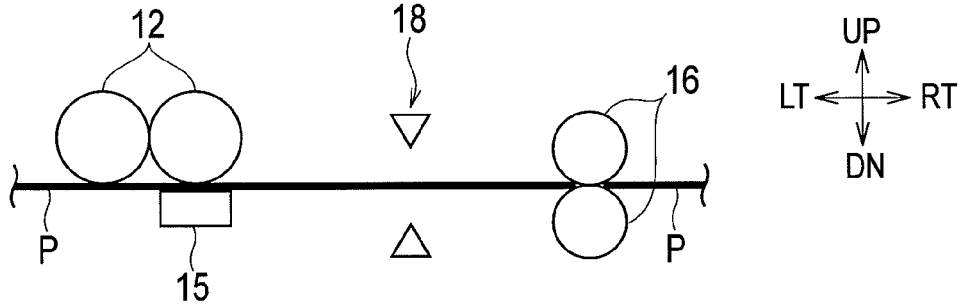

In the pattern shown in FIG. 10, a paper conveyance speed of the paper feed rollers 12 at a time t51 when the trailing end of the precedent paper sheet P passes the paper sensor 18 as shown in FIG. 11A is Vt. Also, a paper conveyance speed of the paper feed rollers 12 at a time t52 when the leading end of the subsequent paper sheet P reaches the paper sensor 18 as shown in FIG. 11B is V1. Moreover, a paper conveyance speed of the paper feed rollers 12 at a time t53 when the trailing end of the precedent paper sheet P passes through the registration rollers 16 and the registration rollers 16 are stopped as shown in FIG. 11C is a print conveyance speed Vg.

In a time period between the times t51 and t52, the registration rollers 16 are driven at the print conveyance speed Vg. The time period between the times t51 and t52 is represented by (V1−Vt)/au1. Therefore, a conveyance distance L1 by the registration rollers 16 within this time period is expressed in the following equation (5). The conveyance distance L1 corresponds to an inter-sheet distance between the precedent paper sheet P and the subsequent paper sheet P at the time t52.

$$L1=Vg\times(V1-Vt)/au1 \quad (5)$$

Moreover, the registration rollers 16 are driven at the print conveyance speed Vg also in a time period between the times t52 and t53. The time period between the times t52 and t53 is represented by (V1−Vg)/|ad1|. A distance in which the inter-sheet distance is reduced during the time period, i.e., a catch-up distance L2 in which the leading end of the subsequent paper sheet P catches up with the trailing end of the precedent paper sheet P is expressed in the following equation (6).

$$L2=(V1-Vg)^2/(2|ad1|) \quad (6)$$

Here, the acceleration rate au1 during increase in speed of the paper feed rollers 12 and the acceleration rate ad1 during reduction in speed thereof are fixed values.

If L1>L2, the subsequent paper sheet P does not catch up with the precedent paper sheet P. The following inequality (7) is derived from the equations (5) and (6) and L1>L2.

$$Vt<V1-(au1/Vg)\times(V1-Vg)^2/(2|ad1|) \quad (7)$$

Here, Vt=V1−(au1/Vg)×(V1−Vg)$^2$/(2|ad1|) and the time between the detection of the trailing end of the precedent paper sheet P and the detection of the leading end of the subsequent paper sheet P by the paper sensor 18 during paper feed is Terr. In this event, the subsequent paper sheet P does not catch up with the precedent paper sheet P if the following inequality (8) is satisfied.

$$Terr>(V1-Vt)/au1 \quad (8)$$

Therefore, when the specified time Tkb=(V1−Vt)/au1 and the inequality (8) is not satisfied, i.e., Terr≤Tkb, the controller 6 suspends the paper feed rollers 12. Thus, the paper sheet can be prevented from passing through the registration rollers.

Figure 12:
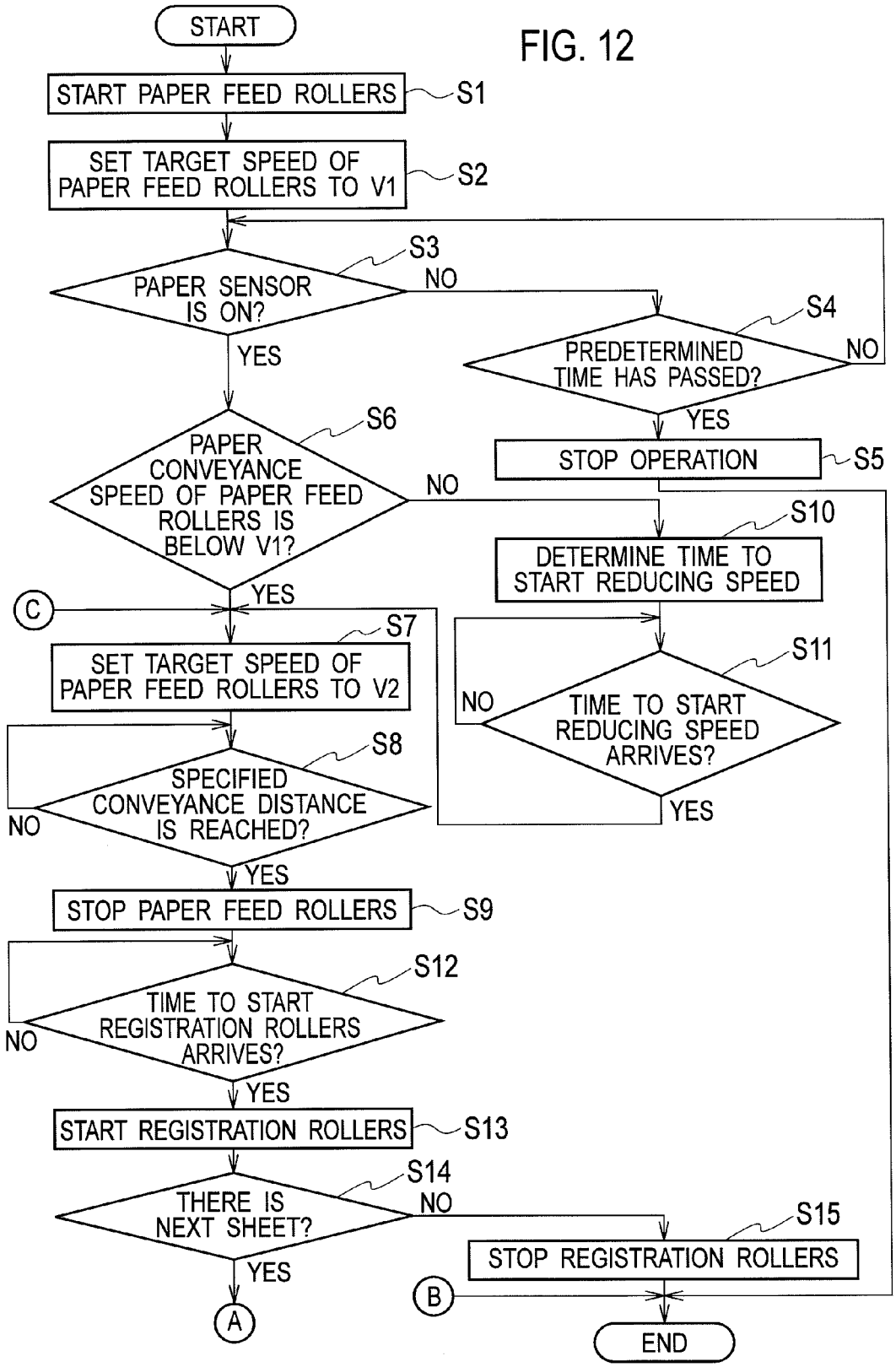
FIG. 12 is a flowchart for explaining a paper feed operation.
Figure 13:
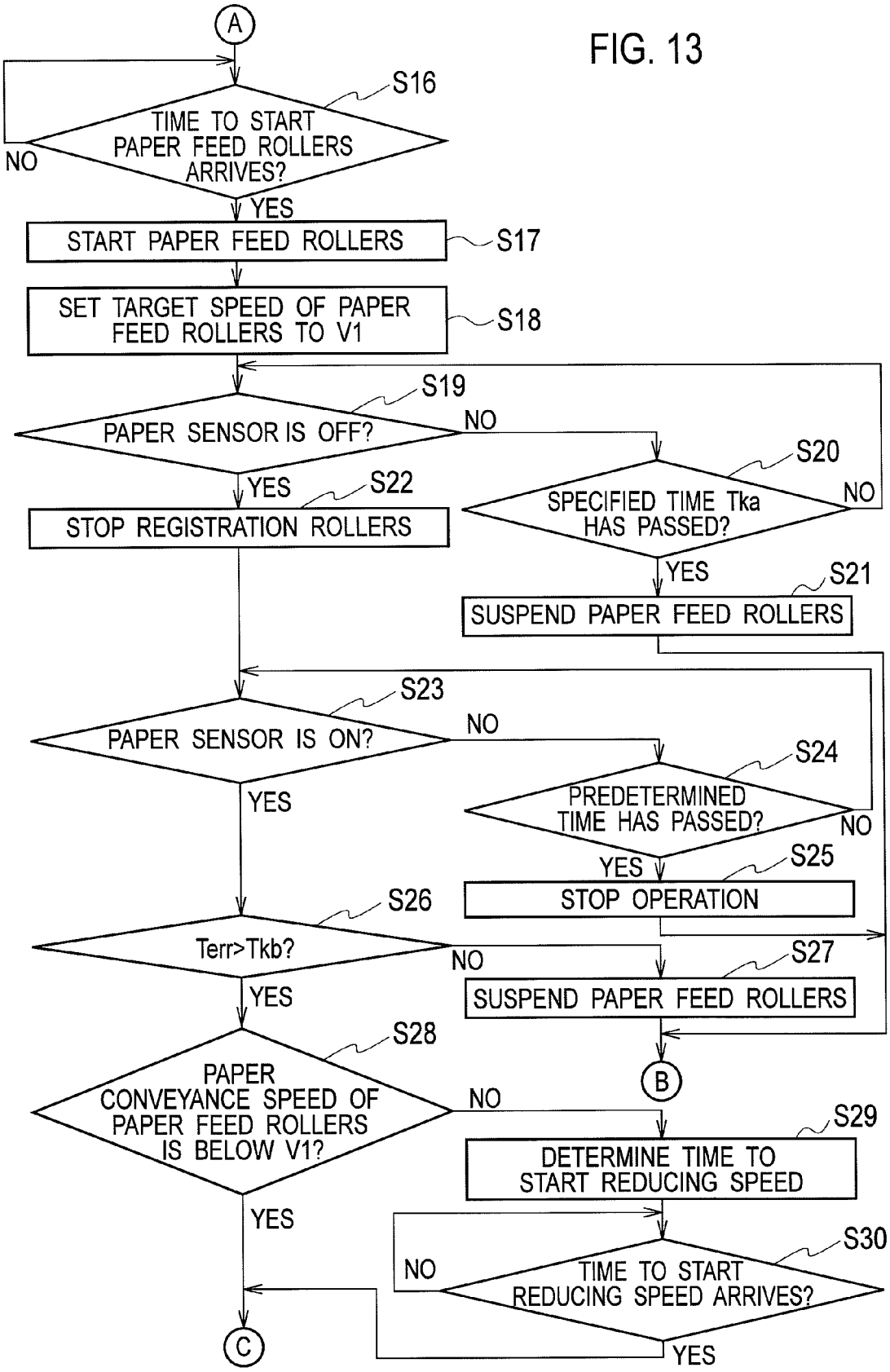
FIG. 13 is a flowchart for explaining the paper feed operation.

Next, a paper feed operation including the first to third duplicate feed countermeasure processing described above will be described with reference to flowcharts of FIGS. 12 and 13. The processing shown in the flowcharts of FIGS. 12 and 13 is started when the printer 1 receives print data from a personal computer, for example.

First, in Step S1, the controller 6 starts the paper feed rollers 12 by the paper feed motor 13.

Next, in Step S2, the controller 6 sets a target speed of the paper feed rollers 12 to V1, and increases the paper conveyance speed of the paper feed rollers 12 at the acceleration rate au1.

Then, in Step S3, the controller 6 determines whether or not the paper sensor 18 is turned on.

When determining that the paper sensor 18 is not turned on (Step S3: NO), the controller 6 determines in Step S4 whether or not a predetermined time has passed after the start of the paper feed rollers 12. When determining that the predetermined time has not passed since the start of the paper feed rollers 12 (Step S4: NO), the controller 6 returns to Step S3.

When determining that the predetermined time has passed after the start of the paper feed rollers 12 (Step S4: YES), the controller 6 stops the operation of the printer 1 as a paper jam error in Step S5.

When determining in Step S3 that the paper sensor 18 is turned on (Step S3: YES), the controller 6 determines in Step S6 whether or not the paper conveyance speed of the paper feed rollers 12 at the point when the paper sensor 18 is turned on is below V1.

When determining that the paper conveyance speed of the paper feed rollers 12 at the point when the paper sensor 18 is turned on is below V1 (Step S6: YES), the controller 6 sets the target speed of the paper feed rollers 12 to V2 and controls the paper conveyance speed of the paper feed rollers 12 to be V2 in Step S7.

Thereafter, in Step S8, the controller 6 determines whether or not the conveyance distance since the start of the paper feed rollers 12 has reached a specified conveyance distance. Here, the controller 6 measures the conveyance distance of the paper feed rollers 12 by counting the number of pulses outputted from the encoder 14. When determining that the conveyance distance since the start of the paper feed rollers 12 has not reached the specified conveyance distance (Step S8: NO), the controller 6 repeats Step S8.

When determining that the conveyance distance since the start of the paper feed rollers 12 has reached the specified conveyance distance (Step S8: YES), the controller 6 stops the paper feed rollers 12 in Step S9. Thus, the leading end of the paper sheet P hits against the registration rollers 16, and the paper sheet P is stopped while being slacked by a predetermined amount.

Steps S6 to S9 when the result of the determination in Step S6 is "YES" correspond to the first duplicate feed countermeasure processing. Also, Steps S28 and S7 to S9 when the result of determination in Step S28 to be described later is "YES" also correspond to the first duplicate feed countermeasure processing.

When determining that the paper conveyance speed of the paper feed rollers 12 at the point when the paper sensor 18 is turned on has reached V1 (Step S6: NO), the controller 6 determines in Step S10 when to start reducing the speed of the paper feed rollers 12 from V1 to V2. Here, the controller 6 determines when to start reducing the speed of the paper feed rollers 12 on the basis of the timing when the leading end of the paper sheet P is detected by the paper sensor 18.

Next, in Step S11, the controller 6 determines whether or not it is time to start reducing the speed of the paper feed rollers 12. When determining that it is not yet the timing to start reducing the speed (Step S11: NO), the controller 6 repeats Step S11. On the other hand, when determining that the timing has come to start reducing the speed (Step S11: YES), the controller 6 proceeds to Step S7.

After the paper feed rollers 12 are stopped in Step S9, the controller 6 determines in Step S12 whether or not it is time to start the registration rollers 16. When determining that it is not yet the timing to start the registration rollers 16 (Step S12: NO), the controller 6 repeats Step S12.

When determining that the timing has come to start the registration rollers 16 (Step S12: YES), the controller 6 starts the registration rollers 16 by the registration motor 17 in Step S13. Also, the controller 6 allows the paper feed rollers 12 to perform an assist operation.

Next, in Step S14, the controller 6 determines whether or not there is a paper sheet to be fed next.

When determining that there is no more paper sheet to be fed (Step S14: NO), the controller 6 terminates the paper feed operation in Step S15 by stopping the registration rollers 16 at the timing when the fed paper sheet P exits the registration rollers 16.

On the other hand, when determining that there is a paper sheet to be fed (Step S14: YES), the controller 6 determines in Step S16 in FIG. 13 whether or not it is time to start the paper feed rollers 12 to feed the next paper sheet P. When determining that it is not yet the timing to start the paper feed rollers 12 (Step S16: NO), the controller 6 repeats Step S16.

When determining that the timing has come to start the paper feed rollers 12 (Step S16: YES), the controller 6 starts the paper feed rollers 12 in Step S17.

Next, in Step S18, the controller 6 sets the target speed of the paper feed rollers 12 to V1, and increases the paper conveyance speed of the paper feed rollers 12 at the acceleration rate au1.

Then, in Step S19, the controller 6 determines whether or not the paper sensor 18 is turned off.

When determining that the paper sensor 18 is not turned off (Step S19: NO), the controller 6 determines in Step S20 whether or not the specified time Tka has passed after the start of the paper feed rollers 12. When determining that the specified time Tka has not passed since the start of the paper feed rollers 12 (Step S20: NO), the controller 6 returns to Step S19.

On the other hand, when determining that the specified time Tka has passed after the start of the paper feed rollers 12 (Step S20: YES), the controller 6 suspends the paper feed rollers 12, as shown in FIG. 9, as a paper jam error in Step S21. Steps S19 to S21 correspond to the second duplicate feed countermeasure processing.

Here, the paper feed rollers 12 are suspended when the precedent paper sheet P and the subsequent paper sheet P are conveyed in the overlapped state as shown in FIG. 9. In this case, the controller 6 allows the print unit 3 to perform printing on the precedent paper sheet P, and the paper discharge unit 4 to discharge the paper sheet. Thereafter, the controller 6 drives the paper feed rollers 12 and the registration rollers 16 to convey the subsequent paper sheet P, of which conveyance is suspended, to the print unit 3. Then, the controller 6 allows the print unit 3 to let the paper sheet pass without printing, and the paper discharge unit 4 to discharge the paper sheet. Also, the controller 6 notifies the user of the suspension and the paper discharge without printing by allowing the operation panel 5 to display such information.

Referring back to FIG. 13, when determining in Step S19 that the paper sensor 18 is turned off (Step S19: YES), the controller 6 stops the registration rollers 16 in Step S22 at the timing when the paper sheet P exits the registration rollers 16.

Next, in Step S23, the controller 6 determines whether or not the paper sensor 18 is turned on.

When determining that the paper sensor 18 is not turned on (Step S23: NO), the controller 6 determines in Step S24 whether or not a predetermined time has passed after the start of the paper feed rollers 12. When determining that the predetermined time has not passed since the start of the paper feed rollers 12 (Step S24: NO), the controller 6 returns to Step S23.

When determining that the predetermined time has passed after the start of the paper feed rollers 12 (Step S24: YES), the controller 6 stops the operation of the printer 1 as a paper jam error in Step S25.

When determining in Step S23 that the paper sensor 18 is turned on (Step S23: YES), the controller 6 determines in Step S26 whether or not the time Terr is larger than the specified time Tkb. The time Terr is the time between turning off (Step S19) and turning on (Step S23) of the paper sensor 18, i.e., the time between the detection of the trailing end of the precedent paper sheet P and the detection of the leading end of the subsequent paper sheet P by the paper sensor 18.

When determining that the time Terr is not more than the specified time Tkb (Step S26: NO), the controller 6 suspends the paper feed rollers 12 in Step S27. Steps S19, S23, S26 and S27 correspond to the third duplicate feed countermeasure processing.

Here, as in the case of Step S21 described above where the paper feed rollers 12 are suspended, after the paper feed rollers 12 are suspended in Step S27, the controller 6 allows the print unit 3 to perform printing on the precedent paper sheet P, and the paper discharge unit 4 to discharge the paper sheet. Thereafter, the controller 6 drives the paper feed rollers 12 and the registration rollers 16 to convey the subsequent paper sheet P, of which conveyance is suspended, to the print unit 3. Then, the controller 6 allows the print unit 3 to let the paper sheet pass without printing, and the paper discharge unit 4 to discharge the paper sheet. Also, the controller 6 notifies the user of the suspension and the paper discharge without printing by allowing the operation panel 5 to display such information.

Referring back to FIG. 13, when determining in Step S26 that the time Terr is larger than the specified time Tkb (Step S26: YES), the controller 6 determines in Step S28 whether or not the paper conveyance speed of the paper feed rollers 12 at the point when the paper sensor 18 is turned on is below V1.

When determining that the paper conveyance speed of the paper feed rollers 12 at the point when the paper sensor 18 is turned on is below V1 (Step S28: YES), the controller 6 proceeds to Step S7 in FIG. 12.

When determining that the paper conveyance speed of the paper feed rollers 12 at the point when the paper sensor 18 is turned on has reached V1 (Step S28: NO), the controller 6 proceeds to Step S29. The processing of Steps S29 and S30 is the same as that of Steps S10 and S11 in FIG. 12 described above.

As described above, in the printer 1, the paper conveyance speed of the paper feed rollers 12 is controlled to be the speed V2, which is lower than the print conveyance speed Vg that is the paper conveyance speed of the registration rollers 16, when the leading end of the paper sheet P is detected by the paper sensor 18 before the paper conveyance speed reaches V1 after the start of the paper feed rollers 12, i.e., before the specified time Tka elapses after the start of the paper feed rollers 12. This increases the inter-sheet distance between the precedent paper sheet P conveyed by the registration rollers 16 at the print conveyance speed Vg and the subsequent paper sheet P conveyed by the paper feed rollers 12 at the speed V2. As a result, in the printer 1, the paper sheet can be prevented from passing through the registration rollers, without any special configuration. Moreover, the paper feed rollers 12 are stopped after the paper sheet is conveyed for the specified conveyance distance by the timing to start the registration rollers 16. Thus, the paper feed can be continued in the same manner as in normal operation by slacking the paper sheet P by a predetermined amount to perform inclination correction.

Also, in the printer 1, the paper feed rollers 12 are suspended when the trailing end of the precedent paper sheet P is not detected by the paper sensor 18 within the specified time Tka after the start of the paper feed rollers 12 and when the leading end of the subsequent paper sheet P is detected within the specified time Tkb after the detection of the trailing end of the precedent paper sheet P. Thus, the paper sheet can be prevented from passing through the registration rollers even in the case where paper sheets overlap due to the duplicate feed or the case where the inter-sheet distance between the paper sheets is very short.

Moreover, in the printer 1, when the paper feed rollers 12 are suspended as described above, the controller 6 allows the print unit 3 to perform printing on the precedent paper sheet P, and the paper discharge unit 4 to discharge the paper sheet P. Thereafter, the controller 6 drives the paper feed rollers 12 and the registration rollers 16 to convey the subsequent paper sheet P, of which conveyance is suspended, to the print unit 3. Then, the controller 6 allows the print unit 3 to let the paper sheet pass without printing, and the paper discharge unit 4 to discharge the paper sheet. Thus, even when the paper feed rollers 12 are suspended, the user no longer needs to remove the paper sheet P from the printer 1. Also, the paper sheet P can be reused unless wrinkles or the like are generated in the paper sheet P, of which conveyance is suspended.

Furthermore, in the printer 1, the distance D is set so as to satisfy the inequality (4). Accordingly, the printer 1 can be configured such that, in normal paper feed, the registration rollers 16 are stopped when the leading end of the paper sheet P reaches the registration rollers 16. Thus, the paper sheet can be prevented from passing through the registration rollers.

Note that at least any one of the second duplicate feed countermeasure processing and the third duplicate feed countermeasure processing may be omitted.

The present invention is not limited to the embodiment described above, but can be embodied by modifying the constituent elements without departing from the scope of the present invention. In addition, various inventions can be formed by suitably combining the constituent elements disclosed in the above embodiment. For example, some of the constituent elements described in the embodiment may be omitted.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A paper feeder comprising:

a paper feed roller configured to pick up a sheet loaded on a paper feed tray and convey the sheet in a conveyance direction;

a registration roller arranged downstream of the paper feed roller in the conveyance direction and configured to convey the sheet conveyed from the paper feed roller;

a detection unit configured to detect the sheet at a position between the paper feed roller and the registration roller; and a controller configured to control the paper feed roller and the registration roller, wherein the controller performs control for each sheet of a plurality of sheets to be fed such that the paper feed roller is started to convey the sheet for a specified conveyance distance so that the sheet is slacked with a leading end of the sheet hitting against the registration roller, the paper feed roller is stopped after the sheet is conveyed for the specified conveyance distance, after the paper feed roller is stopped, the registration roller is started to convey the sheet, and the registration roller is stopped after the sheet exits the registration roller, wherein upon continuous feeding of the plurality of sheets, the controller performs control such that the paper feed roller is started to feed a subsequent sheet while the registration roller conveying a precedent sheet is being driven, wherein a timing of starting the registration roller for the plurality of sheets is predetermined, and wherein upon continuous feeding of the plurality of sheets, and upon detection of the leading end of the sheet by the detection unit before an elapse of a first time after a start of the paper feed roller, the controller further performs control such that a paper conveyance speed of the paper feed roller is set lower than a paper conveyance speed of the registration roller, and the paper feed roller is stopped after conveying the sheet having the leading end detected for the specified conveyance distance before a next timing of starting the registration roller.

2. The paper feeder according to claim 1, wherein upon the elapse of the first time after the start of the paper feed roller without the leading end of the sheet being detected by the detection unit, the controller performs control such that the paper conveyance speed of the paper feed roller is increased to a first speed V1 after the start of the paper feed roller, and is reduced from the first speed V1 to a second speed V2 at or after a point when the leading end of the sheet is detected by the detection unit, and upon continuous feeding of the plurality of sheets, the paper conveyance speed of the registration roller conveying the precedent sheet is set to a third speed Vg being lower than the first speed V1 and higher than the second speed V2 before the start of the paper feed roller to feed the subsequent sheet, and wherein the following inequality is satisfied, $$D>\{(V1-V2)^2/(2|ad1|)-Vg^2/(2|ad2|)\}/(1-V2/Vg),$$

where ad1 denotes a deceleration rate in speed of the paper feed roller from the first speed V1 to the second speed V2, ad2 denotes a deceleration rate in speed in stopping the registration roller, and D denotes a distance on a conveyance path between the detection unit and the registration roller.

3. The paper feeder according to claim 1, wherein upon continuous feeding of the plurality of sheets, the controller further performs at least one of:

suspending the paper feed roller upon the elapse of the first time after the start of the paper feed roller without a trailing end of the precedent sheet being detected by the detection unit; or suspending the paper feed roller upon detection of the leading end of the subsequent sheet within a second time after the detection of the trailing end of the precedent sheet by the detection unit.

4. A printer comprising:

a paper feeder including a paper feed roller configured to pick up a sheet loaded on a paper feed tray and convey the sheet in a conveyance direction, a registration roller arranged downstream of the paper feed roller in the conveyance direction and configured to convey the sheet conveyed from the paper feed roller, a detection unit configured to detect the sheet at a position between the paper feed roller and the registration roller, and a controller configured to control the paper feed roller and the registration roller;

a print unit arranged downstream of the registration roller in the conveyance direction and configured to print the sheet while conveying the sheet being conveyed from the registration roller; and a paper discharge unit configured to discharge the sheet printed by the print unit, wherein the controller performs control for each sheet of a plurality of sheets to be fed such that the paper feed roller is started to convey the sheet for a specified conveyance distance so that the sheet is slacked with a leading end of the sheet hitting against the registration roller, the paper feed roller is stopped after the sheet is conveyed for the specified conveyance distance, after the paper feed roller is stopped, the registration roller is started to convey the sheet, and the registration roller is stopped after the sheet exits the registration roller, wherein upon continuous feeding of the plurality of sheets, the controller performs control such that the paper feed roller is started to feed a subsequent sheet while the registration roller conveying a precedent sheet is being driven, wherein a timing of starting the registration roller for the plurality of sheets is predetermined, and wherein upon continuous feeding of the plurality of sheets, and upon detection of the leading end of the sheet by the detection unit before an elapse of a first time after a start of the paper feed roller, the controller further performs control such that a paper conveyance speed of the paper feed roller is set lower than a paper conveyance speed of the registration roller, and the paper feed roller is stopped after conveying the sheet having the leading end detected for the specified conveyance distance before a next timing of starting the registration roller, wherein upon continuous feeding of the plurality of sheets, the controller further performs at least one of;

suspending the paper feed roller upon the elapse of the first time after the start of the paper feed roller without a trailing end of the precedent sheet being detected by the detection unit; or suspending the paper feed roller upon detection of the leading end of the subsequent sheet within a second time after a detection of the trailing end of the precedent sheet by the detection unit, wherein upon suspension of the paper feed roller, the controller further performs control such that the precedent sheet is printed by the print unit and then a printed precedent sheet is discharged by the paper discharge unit, and after the printed precedent sheet is discharged, the subsequent sheet under suspension of conveyance is conveyed by the paper feed roller and the registration roller, further is conveyed through the print unit without printing, and then is discharged by the paper discharge unit.

* * * * *